US009512694B2

(12) United States Patent
Lopez

(10) Patent No.: US 9,512,694 B2
(45) Date of Patent: Dec. 6, 2016

(54) DOWNHOLE FLOW CONTROL USING POROUS MATERIAL

(75) Inventor: Jean-Marc Lopez, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 514 days.

(21) Appl. No.: 13/990,479

(22) PCT Filed: Aug. 2, 2012

(86) PCT No.: PCT/US2012/049277

§ 371 (c)(1),
(2), (4) Date: May 30, 2013

(87) PCT Pub. No.: WO2014/021893

PCT Pub. Date: Feb. 6, 2014

(65) Prior Publication Data

US 2014/0034324 A1 Feb. 6, 2014

(51) Int. Cl.

| | |
|---|---|
| ***E21B 43/08*** | (2006.01) |
| ***E21B 43/12*** | (2006.01) |
| ***E21B 34/06*** | (2006.01) |

(52) U.S. Cl.

CPC ..... *E21B 34/06* (2013.01); *E21B 43/08* (2013.01); *E21B 43/12* (2013.01)

(58) Field of Classification Search

CPC ..... E21B 43/082; E21B 34/06; E21B 43/12
See application file for complete search history.

(56) References Cited

U.S. PATENT DOCUMENTS

| | | | | |
|---|---|---|---|---|
| 3,586,104 | A | 6/1971 | Hyde | |
| 7,918,272 | B2 | 4/2011 | Gaudette et al. | |
| 2008/0236843 | A1* | 10/2008 | Scott | E21B 43/12 166/386 |
| 2009/0277650 | A1 | 11/2009 | Casciaro et al. | |
| 2011/0315226 | A1* | 12/2011 | Xu | E21B 43/08 137/1 |
| 2012/0186819 | A1 | 7/2012 | Dagenais et al. | |

FOREIGN PATENT DOCUMENTS

| | | |
|---|---|---|
| EP | 939194 | 9/1999 |
| EP | 2045437 | 4/2009 |

OTHER PUBLICATIONS

Singapore Application No. 11201408741S, Written Opinion mailed on Oct. 26, 2015, 6 pages.
Australian Application No. 2012386512, First Examiner Report mailed on Sep. 8, 2015, 3 pages.

(Continued)

*Primary Examiner* — Brad Harcourt
(74) *Attorney, Agent, or Firm* — Kilpatrick Townsend & Stockton LLP

(57) ABSTRACT

A flow control assembly can be disposed in a wellbore and can include a porous material. The porous material can be a temporary plug in a flow path. The porous material may respond to stimuli in a wellbore by creating a flow path, or otherwise allowing fluid to flow in a flow path. The porous material may be located in a port of tubing or proximate, such as adjacent, to an opening in the port.

20 Claims, 6 Drawing Sheets

(56) References Cited

OTHER PUBLICATIONS

Halliburton, First Delta Stim® Completion System Deployed in the Eagle Ford Shale; Saves Customer $1 Million, Case history, available online at http://www.halliburton.com/public/cps/contents/Case_Histories/web/H07303_Eagle%20Ford.pdf, at least as early as Dec. 2009, 2 pages.
Halliburton, Sand Control Screen and Inflow Control Technology Solutions, Product Brochure, available online at http://www.halliburton.com/public/cps/contents/Brochures/web/H08391.pdf, at least as early as Apr. 2012, 2 pages.
Eberhard, Sliding sleeve completions, Halliburton, Williston Basin Petroleum Conference, available online at http://wbpc.ca/pub/documents/archived-talks/2010/Mike_Eberhard_-_Halliburton.pdf, 2009, 7 pages.
Baker Hughes, EQUALIZER-CF Completion Solution Reduced Pay Zone Losses in Mature Field, Case history, available online at http://public.bakerhughes.com/completions-leader/case_histories/03_inflow_control/EQUALIZER-CF%20Completion%20Solution%20Reduced%20Pay%20Zone%20Losses%20in%20Mature%20Field.pdf, 2011, 1 page.
European Application No. 12882455.4, Extended European Search Report mailed on Jun. 20, 2016, 7 pages.
International Patent Application No. PCT/US2012/049277, "International Search Report and Written Opinion", mailed Jan. 29, 2013, 13 Pages.
Singapore Patent Application No. 11201408741S, Written Opinion mailed on Mar. 28, 2016, 5 pages.
Australian Patent Application No. 2012386512, Second Examination Report mailed May 23, 2016, 3 pages.

* cited by examiner

DOWNHOLE FLOW CONTROL USING POROUS MATERIAL

CROSS-REFERENCE TO RELATED APPLICATIONS

This is a U.S. national phase under 35 U.S.C. 371 of International Patent Application No. PCT/US2012/049277, titled "Downhole Flow Control Using Porous Material," filed Aug. 2, 2012, the entirety of which is incorporated herein by reference.

TECHNICAL FIELD OF THE INVENTION

The present invention relates generally to assemblies for controlling fluid flow in a bore in a subterranean formation and, more particularly (although not necessarily exclusively), to assemblies that include porous material that can allow fluid flow in response to a stimuli in the bore.

BACKGROUND

Various devices can be installed in a well traversing a hydrocarbon-bearing subterranean formation. Some devices control the flow rate of fluid between the formation and tubing, such as production or injection tubing. An example of these devices is a flow control device or inflow control device that can be associated with a production interval isolated by packers and that can control production of fluid by creating a pressure drop of fluid flowing through the device.

A completion assembly can be ran downhole with a packer. Pressure can be introduced in the tubing to set the packer. Subsequent to setting the packer, openings or ports in the assembly can be created for fluid production.

Some assemblies include components that facilitate or allow creation of ports for fluid production. For example, an assembly can include openings plugged with aluminum or polylactic acid (PLA) that can dissolve on exposure to acid introduced into the bore (in the case of aluminum) or to an environment of the bore (in the case of PLA). PLA plugs, however, may be unable to withstand pressure above a certain threshold.

Assemblies are desirable, however, that can allow for relatively high pressure to set a packer and then allow for fluid flow without requiring the introduction of acid.

SUMMARY

Certain aspects of the present invention are directed to porous material configured for temporarily blocking fluid flow through a flow control assembly and for allowing fluid flow in response to a stimulus.

One aspect relates to a flow control assembly that includes a tubing portion and a porous material. The tubing portion includes a port that can be part of a flow path in the flow control assembly. The porous material can prevent fluid flow through the flow path in a closed position and can allow fluid to flow in the flow path by opening from the closed position in response to a stimulus in a wellbore.

A feature of the flow control assembly can include the stimulus in the wellbore being a temperature level of an environment of the wellbore.

A feature of the flow control assembly can include the porous material being shape memory foam.

A feature of the flow control assembly can include the porous material being magnetic memory alloy.

A feature of the flow control assembly can include the stimulus being a magnetic field from a device provided in the wellbore from a surface of the wellbore.

A feature of the flow control assembly can include the porous material being configured to return to the closed position in response to a second magnetic field from a second device provided in the wellbore from the surface subsequent to the device being provided in the wellbore from the surface.

A feature of the flow control assembly can include the porous material having pores that can increase in size to cause the porous material to open.

A feature of the flow control assembly can include the porous material being located in the port.

A feature of the flow control assembly can include the porous material being located external to the tubing portion and adjacent to a port opening of the port.

A feature of the flow control assembly can include the porous material in the closed position being configured to provide a pressure seal between an inner area defined by the tubing portion and an outer area defined by the tubing portion.

A feature of the flow control assembly can include a housing and an inflow control device. The housing can be external to the tubing portion and can define a second part of the flow path. The inflow control device can be positioned in the second part of the flow path defined by the tubing portion and positioned between the housing and an outer wall of the tubing portion.

A feature of the flow control assembly can include the stimulus being a fluid introduced from a surface of the wellbore.

Another aspect relates to a flow control assembly that can be disposed in a wellbore traversing a subterranean formation. The flow control assembly includes a tubing portion and a porous material. The tubing portion has a port. The porous material can provide a pressure seal between an inner area defined by the tubing portion and an outer area defined by the tubing portion. The porous material includes pores that can increase in size for creating a flow path in the flow control assembly in response to a stimulus in the wellbore.

Another aspect relates to a flow control assembly that can be disposed in a wellbore traversing a subterranean formation. The flow control assembly includes a tubing portion and a porous material. The tubing portion has a port that can be part of a flow path in the flow control assembly. The porous material can provide a pressure seal between an inner area defined by the tubing portion and an outer area defined by the tubing portion. The porous material can open from a closed position in response to a stimulus in the wellbore to allow fluid to flow in the flow path.

These illustrative aspects and features are mentioned not to limit or define the invention, but to provide examples to aid understanding of the inventive concepts disclosed in this disclosure. Other aspects, advantages, and features of the present invention will become apparent after review of the entire disclosure.

DETAILED DESCRIPTION

Figure 1:
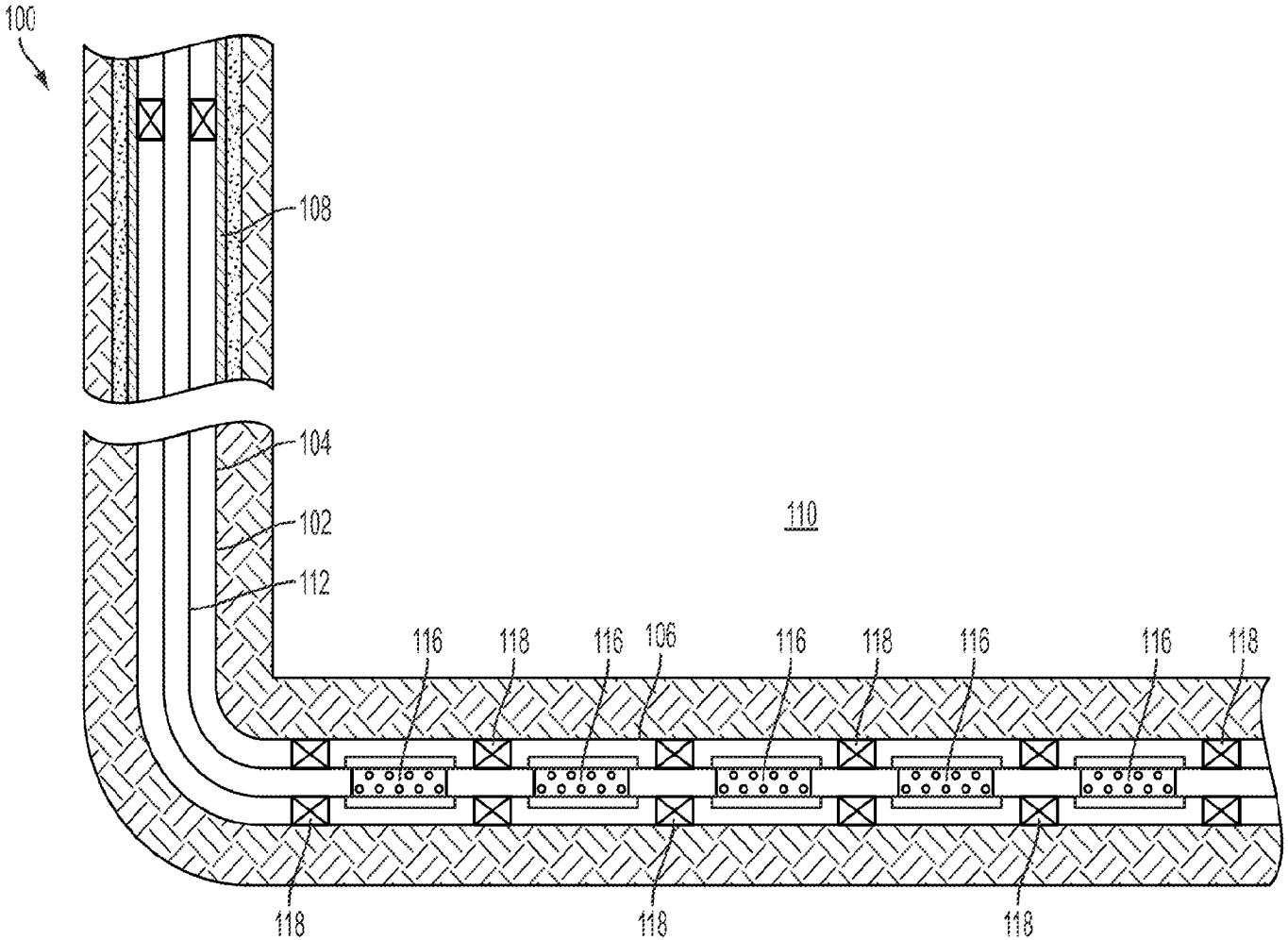
FIG. 1 is a schematic illustration of a well system having production internals in which are flow control assemblies according to one aspect of the present invention.

Certain aspects and features relate to a flow control assembly that includes a porous material that can be a temporary plug in a flow path. The porous material may respond to stimuli in a wellbore by creating a flow path, or otherwise allowing fluid to flow in a flow path. The porous material may be located in a port of a tubing or proximate, such as adjacent, to an opening in the port. The porous material can provide a pressure seal to allow a packer or other completion tools to be set. The porous material can respond to the stimuli after the completion tool is set by allowing for a flow path through the flow control assembly. For example, the porous material can include pores that can increase in size to allow for fluid flow through the porous material. The porous material may remain in the flow control assembly subsequent to opening to allow fluid flow.

The porous material may be a cellular structure that includes a continuous material having pores. The continuous material can provide a frame in which pores can be located. A pore can be an empty space within the continuous material. The pores can interconnect or interlink such that the pores form a series of channels through the porous material. The channels can be blocked when the porous material is in closed position and the channels can be unblocked when the porous material is in an open position.

Examples of porous material include a solid material, metal alloy, or foam, such as carbon foam, silicone foam, silicone carbine foam, metal foam, polyester foam, polyurethane foam, an epoxy having dissolvable porous medium, silicon carbon foam, memory shape foam, memory shape material, magnetic memory alloy such as those including nickel or tungsten, fibrous materials, and plastic foam.

In some aspects, the porous material is foam material having pores or cells that can respond to temperature or other stimuli by opening. The foam material can be configured to not degrade in response to be exposed to the stimuli or other elements of a wellbore environment. The foam material may be able to return to an initial form, such as the pores or cells closing.

Examples of stimuli include a temperature level of a wellbore environment, fluid introduced from the surface, and a magnetic field.

In one aspect, a sub-assembly that may be part of a tubing portion includes an opening in the tubing portion, a porous material, and a housing defining part of a flow path. The sub-assembly can be run downhole in a closed position in which the porous material is configured to prevent, or substantially prevent, fluid flow through the flow path including through the opening. For example, the porous material can include pores that can have a relatively small size in the closed position to prevent, or substantially prevent, fluid flow through the porous material. Stimuli may be present or introduced into the wellbore. For example, the stimuli may be fluid that is pumped into the wellbore, a temperature that is present in the wellbore, or a magnetic field provided by a device introduced into the wellbore. The porous material can open in response to the stimuli to allow fluid to flow through the porous material. For example, the size of the pores can increase to allow fluid flow.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present invention.

FIG. 1 depicts a well system 100 with flow control assemblies according to certain aspects of the present invention. The well system 100 includes a bore that is a wellbore 102 extending through various earth strata. The wellbore 102 has a substantially vertical section 104 and a substantially horizontal section 106. The substantially vertical section 104 and the substantially horizontal section 106 may include a casing string 108 cemented at an upper portion of the substantially vertical section 104. The substantially horizontal section 106 extends through a hydrocarbon bearing subterranean formation 110.

A tubing string 112 extends from the surface within wellbore 102. The tubing string 112 can provide a conduit for formation fluids to travel from the substantially horizontal section 106 to the surface. Production tubular sections 116 in various production intervals adjacent to the formation 110 are positioned in the tubing string 112. On each side of each production tubular section 116 is a packer 118 that can provide a fluid seal between the tubing string 112 and the wall of the wellbore 102. Each pair of adjacent packers 118 can define a production interval.

One or more of the production tubular sections 116 can include a flow control assembly. The flow control assembly can include one or more openings in the tubing string 112 and porous material that can respond to stimuli by opening to create a flow path, which may include the openings in the tubing string.

Although FIG. 1 depicts production tubular sections 116 that can include flow control assemblies positioned in the substantially horizontal section 106, production tubular sections 116 (and flow control assemblies) according to various aspects of the present invention can be located, additionally or alternatively, in the substantially vertical section 104. Furthermore, any number of production tubular sections 116 with flow control assemblies, including one, can be used in the well system 100 generally or in each production interval. In some aspects, production tubular sections 116 with flow control assemblies can be disposed in simpler wellbores, such as wellbores having only a substantially vertical section. Flow control assemblies can be disposed in open hole environments, such as is depicted in FIG. 1, or in cased wells.

Figure 2:
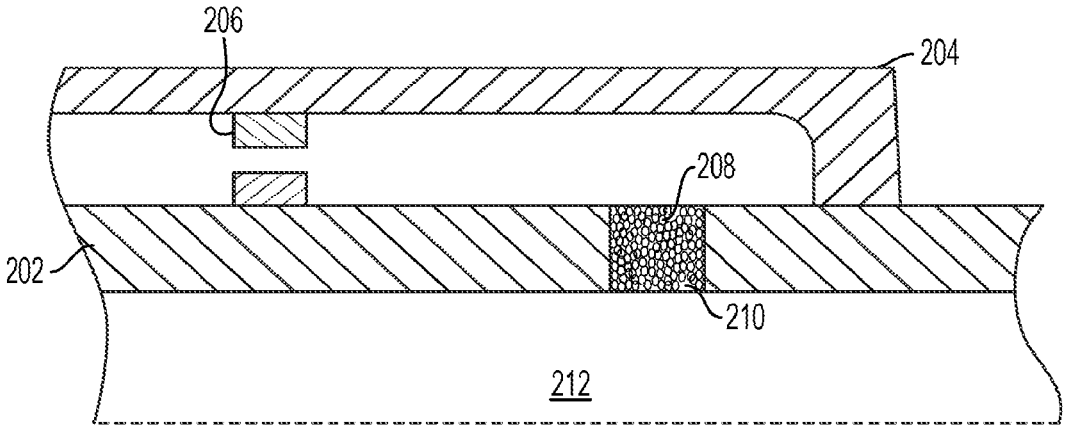
FIG. 2 is a cross-sectional view of part of a flow control assembly that includes porous material in a closed position according to one aspect of the present invention.
Figure 3:
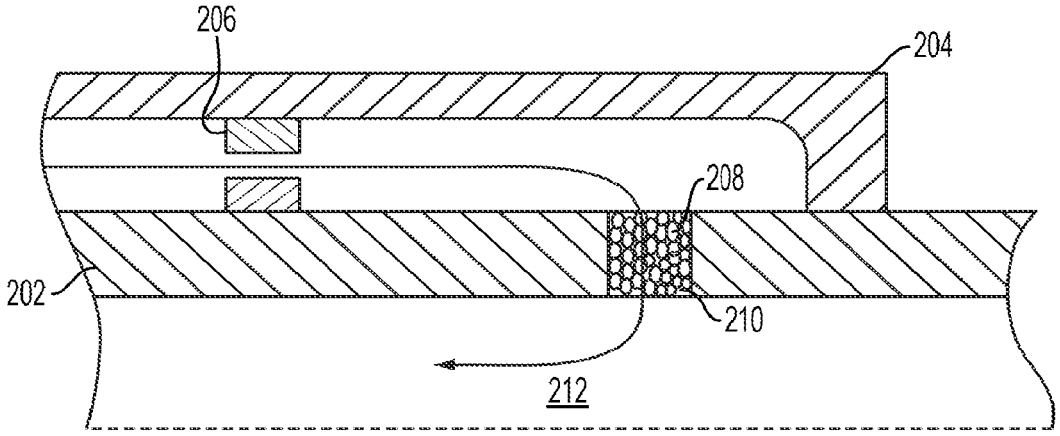
FIG. 3 is a cross-sectional view of the part of the flow control assembly of FIG. 2 with the porous material in an open position according to one aspect of the present invention.

FIGS. 2-3 cross-sectionally depict part of a flow control assembly according to one aspect. The flow control assembly includes a tubing portion 202, a housing 204, an inflow control device 206, and porous material 208. The tubing portion 202 includes port 210 in which the porous material 208 is located. The housing 204 is external to the tubing portion 202 and defines part of a flow path through which fluid can flow. The inflow control device 206 and porous material 208 are located in the flow path. The port 210 may be part of the flow path.

FIG. 2 depicts the flow control assembly in a closed position, which may be an initial position when the flow control assembly is run into the wellbore. In the closed position, the porous material 208 is closed and can prevent, or substantially prevent, fluid flow through the flow path, such as through the port 210. In the closed position, the porous material 208 may provide a pressure seal between an inner area defined by the tubing portion 202 and an area external to the tubing portion 202. In some aspects, the porous material 208 can be closed when pores of the porous material 208 are of relatively small size and block channels that may be in the porous material.

FIG. 3 depicts the flow control assembly in an open position. In the open position, the porous material 208 can create a flow path through the port 210 by allowing fluid to flow through the port 210 to the inner area 212 defined by the tubing portion 202, as represented by the arrow in FIG. 3. The porous material 208 can create the flow path in response to stimuli in the wellbore. For example, pores in the porous material 208 may increase in size to allow fluid flow through channels in the porous material 208, and through the port 210.

In other aspects, the flow control assembly does not include the inflow control device 206. In some aspects, the flow control assembly includes other components, such as screens and filter media.

Figure 4:
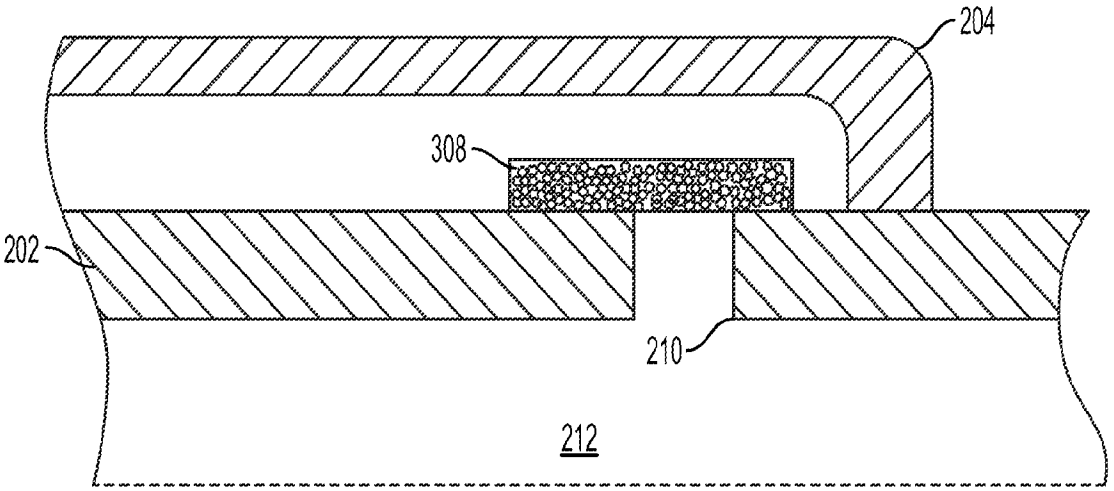
FIG. 4 is a cross-sectional view of part of a flow control assembly that includes porous material according to another aspect of the present invention.

The porous material 208 may be disposed in locations other than in the port 210. FIG. 4 cross-sectionally depicts one aspect of the flow control assembly of FIGS. 2-3 in which porous material 308 is located external to the tubing portion 202 and close to an opening in the port 210 of the tubing portion 202. For example, the porous material 308 can be located adjacent to the opening in the port 210. The porous material 308 in a closed position, as shown in FIG. 4, can prevent, or substantially prevent, fluid from flowing to the port 210 from a flow path defined by the housing 204. In some aspects, the porous material 308 in the closed position can provide a pressure seal between an inner area 212 defined by the tubing portion 202 and an area of the wellbore that is external to the tubing portion 202. In response to stimuli in the wellbore, the porous material 308 can change to an open position and allow fluid to flow to the port 210 and to the inner area 212 defined by the tubing portion 202.

In other aspects, the porous material is located in the inner area 212 defined by the tubing portion 202 and adjacent to an opening in the port 210.

Porous material according to some aspects is configured to respond to stimuli from one or more devices introduced into the wellbore. For example, a ball having a certain charge that causes the ball to output a magnetic field can be introduced into the wellbore from the surface. Porous material in a flow control assembly in the wellbore can respond to the magnetic field by changing from a closed position to an open position or from an open position to a closed position.

Figure 5:
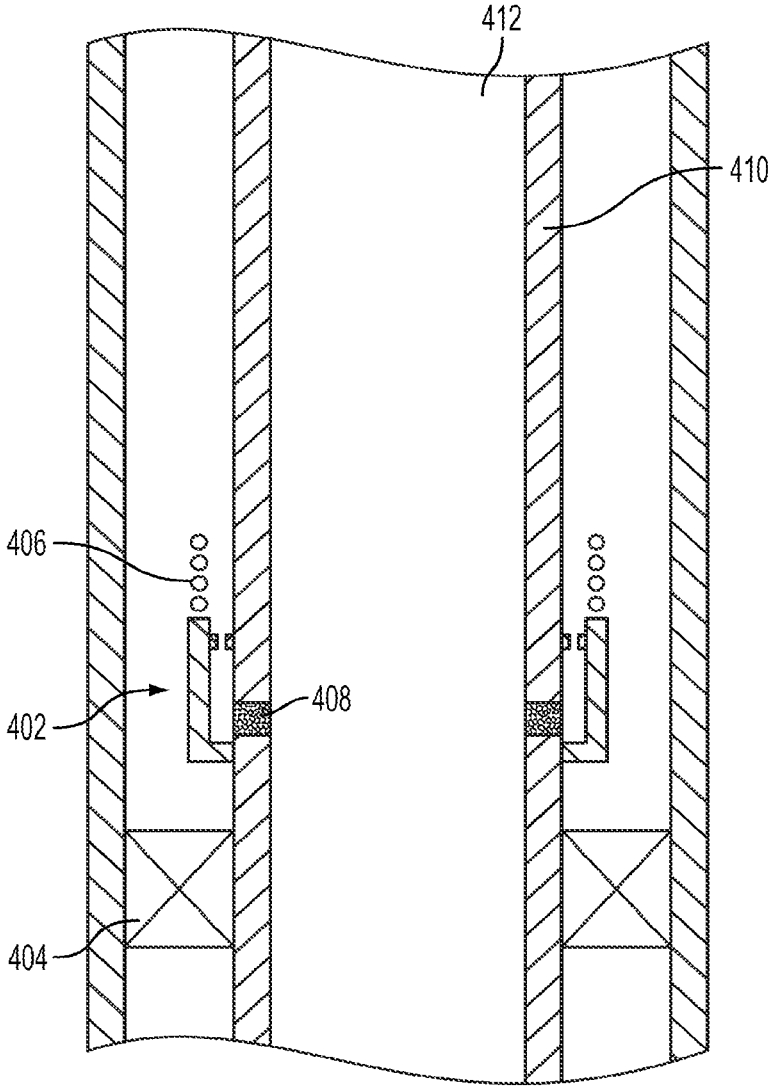
FIG. 5 is a cross-sectional view of part of a wellbore in which porous material of a flow control assembly is in a closed position according to one aspect of the present invention.
Figure 6:
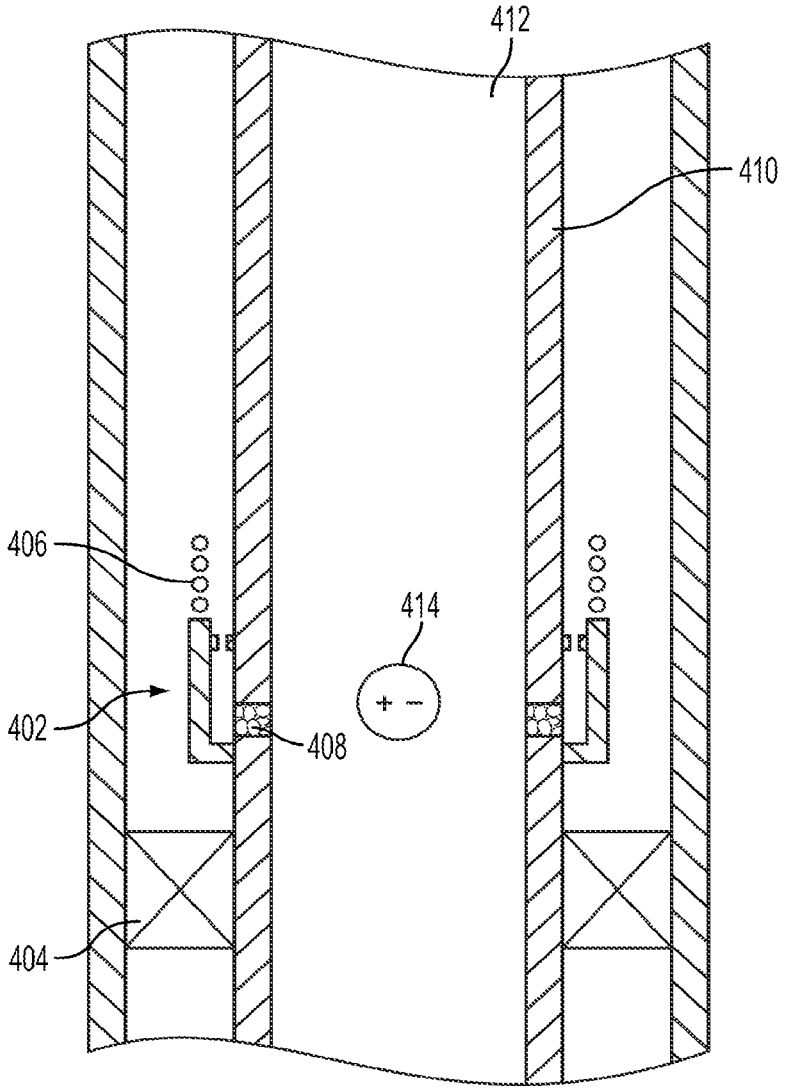
FIG. 6 is a cross-sectional view of the part of the wellbore of FIG. 5 in which the porous material is in an open position in response to a magnetic field according to one aspect of the present invention
Figure 7:
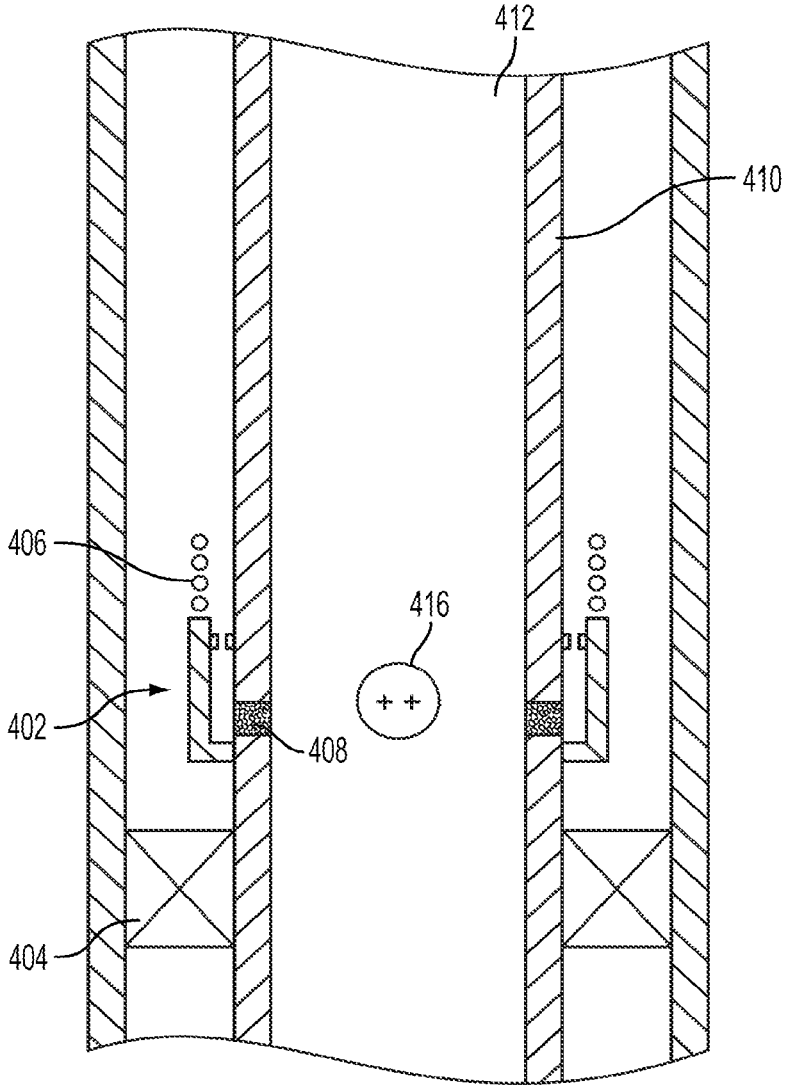
FIG. 7 is a cross-sectional view of the part of the wellbore of FIG. 5 in which the porous material is in a closed position in response to a magnetic field according to one aspect of the present invention.

FIGS. 5-7 depict by cross-section part of a downhole wellbore in which is included a flow control assembly 402 and a packer 404 according to one aspect. The flow control assembly 402 is associated with or includes a screen 406 that may be used with a filter media for filtering fluid prior to the fluid entering a flow path in the flow control assembly 402. The flow control assembly 402 includes porous material 308 in ports of a tubing portion 410. The packer 404 may be between a casing portion 405 and the tubing portion 410.

FIG. 5 depicts the porous material 408 in a closed position such as may be an initial position such as when the packer 404 is being set. In the closed position, the porous material 408 may prevent, or substantially prevent, fluid flow through the ports to an inner area 412 defined by the tubing portion 410. In some aspects, the porous material 408 may provide a pressure seal when in the closed position between the inner area 412 defined by the tubing portion 410 and an area of the wellbore external to the tubing portion 410.

FIG. 6 depicts the downhole wellbore in which a device 414 is moving through the inner area 412 of the tubing portion 410 by the flow control assembly 402. The device 414 may be a ball introduced from the surface and have a certain electric charge (represented as an example only by "+" and "−" in FIG. 6). The device 414 with the electric charge may emit or output a magnetic field that is a stimulus. The porous material 408 may be a metal alloy or similar material that can respond to the magnetic field by changing from the closed position to an open position. FIG. 6 depicts the porous material 408 in the open position. In the open position, the porous material 408 can create or allow a flow path through the ports in the tubing portion 410. For example, pores in the porous material 408 can enlarge or otherwise increase in size to allow fluid to flow through channels in the porous material 408. Fluid can flow through the flow path to the inner area 412 defined by the tubing portion 410. The device 414 can continue through the inner area 412 of the tubing portion 410 until it is at an end of the wellbore, where it may be rest or be retrieved.

FIG. 7 depicts the downhole wellbore in which a second device 416 is moving through inner area 412 of the tubing portion 410 by the flow control assembly 402. The second device 416 may be introduced from the surface subsequent to device 414 being introduced from the surface. The second device 416 have a certain electric charge (represented as an example only by "+" and "+" in FIG. 7), which may be different or the same as the electric charge of device 414 in FIG. 6. The second device 416 with the electric charge may emit or output a magnetic field that is a stimulus. The porous material 408 can respond to the magnetic field by changing from the open position back to a closed position. FIG. 7 depicts the porous material 408 in the closed position. The porous material 408 in the closed position can prevent fluid flow through the port of the tubing portion 410. In some aspects, the porous material 408 in the closed position can provide a pressure seal between the inner area 412 and an area of the wellbore external to the tubing portion 410.

The foregoing description of the aspects, including illustrated aspects, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. A flow control assembly, comprising:

a tubing portion having a port configured to be part of a flow path in the flow control assembly;

a porous material configured for preventing fluid flow though the flow path in a closed position and for allowing fluid to flow in the flow path by opening from the closed position in response to a stimulus in a wellbore;

a housing external to the tubing portion and defining a second part of the flow path; and an inflow control device positioned (i) in the second-part of the flow path defined by the tubing portion and (ii) between the housing and an outer wall of the tubing portion.

2. The flow control assembly of claim 1, wherein the stimulus in the wellbore is a temperature level of an environment of the wellbore.

3. The flow control assembly of claim 2, wherein the porous material is shape memory foam.

4. The flow control assembly of claim 1, wherein the porous material is magnetic memory alloy.

5. The flow control assembly of claim 4, wherein the stimulus is a magnetic field from a device provided in the wellbore from a surface of the wellbore.

6. The flow control assembly of claim 5, wherein the porous material is configured to return to the closed position in response to a second magnetic field from a second device provided in the wellbore from the surface subsequent to the device being provided in the wellbore from the surface.

7. The flow control assembly of claim 1, wherein the porous material comprises pores configured to increase in size to cause the porous material to open.

8. The flow control assembly of claim 1, wherein the porous material is located in the port.

9. The flow control assembly of claim 1, wherein the porous material is located external to the tubing portion and adjacent to a port opening of the port.

10. The flow control assembly of claim 1, wherein the porous material in the closed position is configured to provide a pressure seal between an inner area defined by the tubing portion and an outer area defined by the tubing portion.

11. The flow control assembly of claim 1, wherein the stimulus is a fluid introduced from a surface of the wellbore.

12. A flow control assembly configured to be disposed in a wellbore traversing a subterranean formation, the flow control assembly comprising:

a tubing portion having a port;

a porous material configured for providing a pressure seal between an inner area defined by the tubing portion and an outer area defined by the tubing portion, the porous material comprising pores configured to increase in size for creating a flow path in the flow control assembly in response to a stimulus in the wellbore;

a housing external to the tubing portion and defining a part of the flow path; and an inflow control device positioned (i) in the part of the flow path defined by the tubing portion and (ii) between the housing and an outer wall of the tubing portion.

13. The flow control assembly of claim 12, wherein the port is configured to define part of the flow path.

14. The flow control assembly of claim 12, wherein the porous material is shape memory foam, wherein the stimulus in the wellbore is a temperature level of an environment of the wellbore or fluid introduced into the wellbore from a surface of the wellbore.

15. The flow control assembly of claim 12, wherein the porous material is magnetic memory alloy, wherein the stimulus is a magnetic field from a device provided in the wellbore from a surface of the wellbore.

16. The flow control assembly of claim 15, wherein the porous material is configured to close in response to a second magnetic field from a second device provided in the wellbore from the surface subsequent to the device being provided in the wellbore from the surface.

17. A flow control assembly configured to be disposed in a wellbore traversing a subterranean formation, the flow control assembly comprising:

a tubing portion having a port configured to be part of a flow path in the flow control assembly; and a porous material that is magnetic memory alloy configured for providing a pressure seal between an inner area defined by the tubing portion and an outer area defined by the tubing portion, and for opening from a closed position in response to a stimulus that is a magnetic field from a first device provided in the wellbore from a surface of the wellbore to allow fluid to flow in the flow path.

18. The flow control assembly of claim 17, wherein the porous material comprises pores configured to increase in size to cause the porous material to open.

19. The flow control assembly of claim 17, wherein the porous material is configured to close in response to a second magnetic field from a second device provided in the wellbore from the surface subsequent to the first device being provided in the wellbore from the surface.

20. The flow control assembly of claim 17, further comprising:

a housing external to the tubing portion and defining a second part of the flow path; and an inflow control device positioned (i) in the second part of the flow path defined by the tubing portion and (ii) between the housing and an outer wall of the tubing portion.

* * * * *